United States Patent [19]

Chuang

[11] Patent Number: 4,947,215

[45] Date of Patent: Aug. 7, 1990

[54] TRANSFER APPARATUS

[75] Inventor: Thomas C. Chuang, West Chester, Pa.

[73] Assignee: Xerox Corporation, Stamford, Conn.

[21] Appl. No.: 436,845

[22] Filed: Nov. 15, 1989

[51] Int. Cl.[5] ..... G03G 15/16

[52] U.S. Cl. ..... 355/274; 355/356; 355/326; 355/315

[58] Field of Search ..... 355/274, 273, 326, 327, 355/256, 315

[56] References Cited

U.S. PATENT DOCUMENTS

| | | | |
|---|---|---|---|
| 3,924,943 | 12/1975 | Fletcher | 355/274 |
| 4,063,808 | 12/1977 | Simpson | 355/274 |
| 4,072,412 | 2/1978 | Suda et al. | 355/274 |
| 4,382,673 | 5/1983 | Nakajima et al. | 355/274 |
| 4,415,256 | 12/1983 | Inoue et al. | 355/274 |
| 4,480,906 | 12/1984 | Titus et al. | 355/327 X |
| 4,601,963 | 7/1986 | Takahashi et al. | 430/69 |
| 4,607,935 | 8/1986 | Kindt et al. | 355/274 |
| 4,737,816 | 4/1988 | Inoue et al. | 355/315 |
| 4,875,069 | 10/1989 | Takada et al. | 355/326 X |
| 4,888,621 | 12/1989 | Ohno | 355/326 |

*Primary Examiner*—A. T. Grimley
*Assistant Examiner*—Sandra L. Hoffman
*Attorney, Agent, or Firm*—H. Fleischer; J. E. Beck; R. Zibelli

[57] ABSTRACT

An apparatus which transfers a liquid image from an image support surface to a sheet. A deformable cylindrical member made from a flexible, dielectric material presses the sheet against the image support surface. As the cylindrical member presses the sheet against the image support surface, it deforms to define a transfer area. A conductive roll, disposed interiorly of the cylindrical member in the transfer area, tacks the liquid image to the image support surface. A corona generating device, positioned adjacent the conductive roll interiorly of the cylindrical member, transfers the liquid image from the image support surface to the sheet.

14 Claims, 2 Drawing Sheets

TRANSFER APPARATUS

This invention relates generally to a color printing machine, and more particularly concerns an apparatus which transfers successive liquid images from a photoconductive surface to a sheet.

There are different printing processes employed to make color proof copies. One such technique produces multiple color proof copies from halftone film separations. Initially, an electrostatic master is exposed to a halftone film separation. This forms an electrostatic latent image on the master corresponding to the halftone film separation. Four masters are made. One of the masters corresponds to black with the other masters corresponding typically to the subtractive primary colors of the desired proof copy. The masters are then placed in the printing machine and secured to rotating cylinders. One master is mounted releasably on each cylinder. Each master is charged to a substantially uniform potential. The charge bleeds away except in the image areas to form an electrostatic latent image thereon corresponding to the image areas of the halftone film separation The latent image is developed by bringing a liquid developer material into contact therewith. The liquid developer material comprises a liquid carrier having pigmented particles dispersed therein. The pigmented particles are deposited, in image configuration, on the master. These latent images are developed with developer material having a color corresponding to the substrative primary color of the corresponding halftone film separation. Thereafter, the differently colored developed images are transferred from the masters to the sheet in superimposed registration with one another. Heat is then applied to permanently fuse the image to the sheet so as to form a color proof copy. A linear printing machine of this type is rather large and requires four linear printing stations, i.e. one printing station for each master. Alternatively, a recirculating type of printing may be used in which one printing station is used a plurality of cycles. In this type of printing machine, the copy sheet is recirculated for four cycles with a different color image being transferred thereto during each cycle. This necessitates the placement of the four masters on a common drum, or alternatively, recording four electrostatic latent images on the drum. This may be achieved by using an electrophotographic printing process.

In an electrophotographic printing machine, a photoconductive member is charged to a substantially uniform potential to sensitize the surface thereof. The charged portion of the photoconductive member is exposed. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing developer material into contact therewith. This forms a developed image on the photoconductive member which is subsequently transferred to a copy sheet. The copy sheet is heated to permanently affix the image thereto.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with developer material of a color complementary thereto. This process is repeated a plurality of cycles for differently colored images and their respective complementarily colored developer material. Each single color developed image is transferred to the copy sheet in superimposed registration with the prior image. This creates a multi-colored image on the copy sheet. which is permanently affixed thereto creating a color copy. A printing machine designed to produce high quality color proofs uses a liquid developer material. It is thus necessary to employ a transfer apparatus which is capable of transferring a plurality of different color liquid images in superimposed registration with one another without smear or degradation of image quality.

Various approaches have been devised for for transferring powder images from a photoconductive member to a copy sheet. The following disclosures appear to be relevant:

U.S. Pat. No. 3,924,943; Patentee: Fletcher; Issued: Dec. 9, 1975.

U.S. Pat. No. 4,063,808; Patentee: Simpson; Issued: Dec. 20, 1977.

U.S. Pat. No. 4,382,673; Patentee: Nakajima et al.; Issued: May 10, 1983.

U.S. Pat. No. 4,601,963; Patentee: Takahashi et al.; Issued: July 22, 1986.

U.S. Pat. No. 4,607,935; Patentee: Kindt et al.; Issued: Aug. 26, 1986.

The relevant portions of the foregoing patents may be briefly summarized as follows:

U.S. Pat. No. 3,924,943 discloses a transfer roller made from a thin outer layer, an electrically relaxable inner layer and a central cylindrical conductive core. A constant current electrical bias is electrically connected to the conductive core. The relaxable layer is made from a thick layer of a low durometer elastomeric material. The transfer roll is pressed into contact with the photoconductive drum and deflects to form an extended transfer zone.

U.S. Pat. No. 4,063,808 describes a transfer roller made from a conductive metal hub surrounded by a resilient rubber layer having a thin flexible dielectric layer on the exterior circumferential surface thereof. The transfer roller is pressed into engagement with the photoconductive drum and deflects to form an extended transfer zone.

U.S. Pat. No. 4,382,673 describes a transfer roller in the form of a brush roll. The transfer roller is made from an aluminum cylindrical core or bar having an elastic layer of foaming polyurethane formed on the outer circumferential surface thereof. An electrically conductive adhesive is coated on the circumference and ends of the elastic layer. Surface furs are planted in the adhesive layer and extend outwardly therefrom.

U.S. Pat. No. 4,601,963 discloses a photoreceptor made from a shaft having an elastic cylindrical core mounted thereon and an outer layer comprising a supporting layer and a photosensitive layer. The photoreceptor is constructed in the shape of a drum being adapted to deform locally while maintaining the remainder of the drum nondeformed.

U.S. Pat. No. 4,607,935 discloses a film sheet interposed between a compliant back-up roller and a transfer roller. A receiver sheet is releasably secured to the transfer roller. As the film passes through the nip defined by the back-up roller and transfer roller, the image on the film is transferred to the sheet. The back-up roller rather than the transfer roller is complaint.

Pursuant to the features of the present invention, there is provided an apparatus for transferring a liquid image from an image support surface to a sheet. A deformable cylindrical member presses the sheet against the image support surface and deforms to define a transfer area. The cylindrical member is made of a dielectric material. Means, disposed interiorly of the cylindrical member in the region of the transfer area, tack the liquid image to the image support surface. Means, disposed interiorly of the cylindrical member in the region of the transfer area adjacent the tacking means, transfers the liquid image from the image support surface to the sheet.

In another aspect of the present invention, there is provided a printing machine of the type in which a liquid image is transferred from a photoconductive drum to a sheet. The improved printing machine includes a deformable cylindrical member comprised of a dielectric material. The cylindrical member deforms to define a transfer area when pressing the sheet against the photoconductive drum. Means, disposed interiorly of the cylindrical member in the region of the transfer area, tack the liquid image to the photoconductive drum. Means, disposed interiorly of the cylindrical member in the region of the transfer area adjacent the tacking means, transfer the liquid image from the photoconductive drum to the sheet.

Other aspects of the present invention will become apparent as the following description proceeds and upon reference to the drawings, in which.

Figure 1:
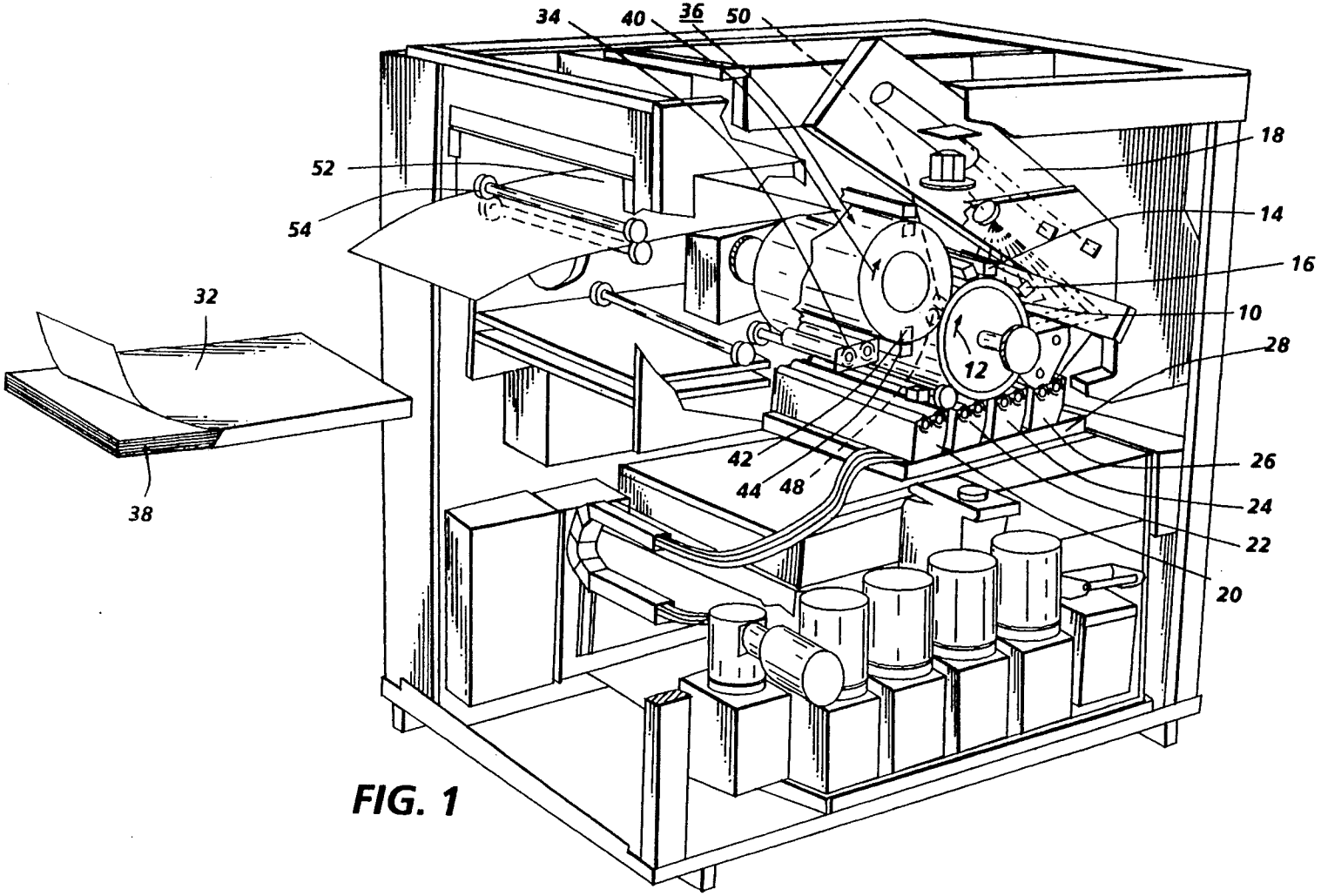
FIG. 1 is a schematic perspective view showing an illustrative printing machine incorporating the features of the present invention therein.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements. It will become evident from the following discussion that the present invention is equally well suited for use in a wide variety of printing machines, and is not necessarily limited in its application to the particular machine shown herein.

Figure 2:
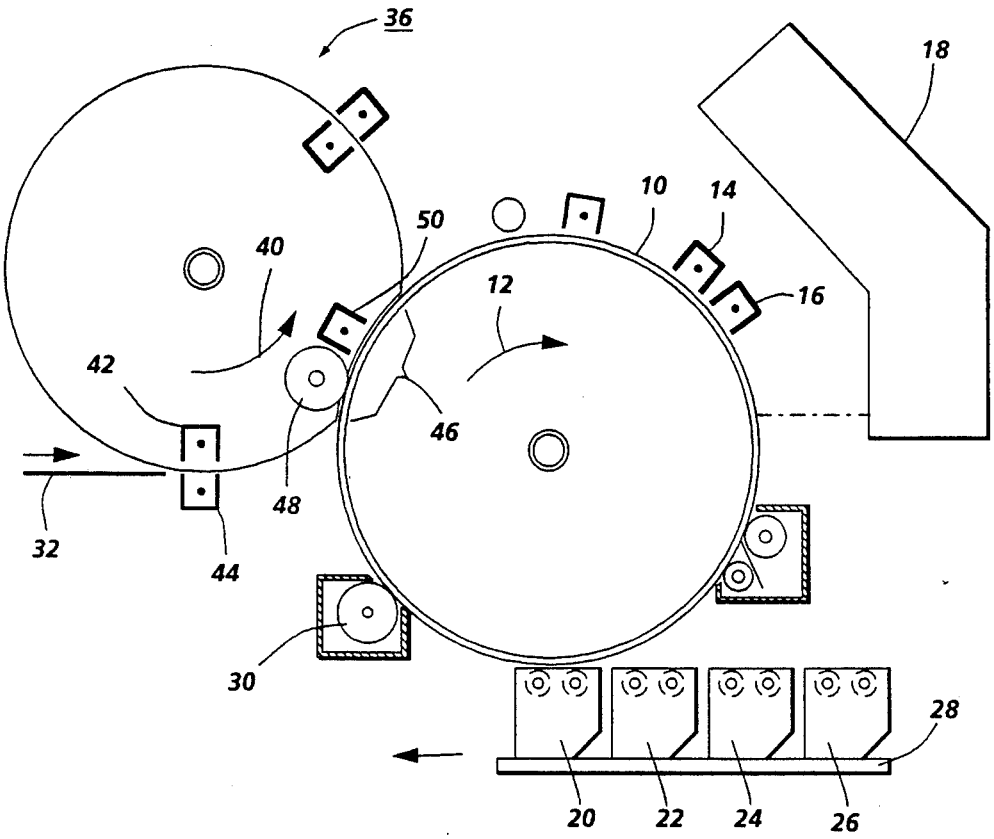
FIG. 2 is a schematic elevational view depicting a portion of the FIG. 1 printing machine.

Referring now to FIGS. 1 and 2, there is shown a printing machine employing a photoconductive drum 10. Preferably, the photoconductive drum 10 is made from a selenium alloy coated on an aluminum grounding layer. Other suitable photoconductive materials and grounding layers may also be employed. Drum 10 rotates in the direction of arrow 12 to advance successive portions of the photoconductive surface sequentially through the various processing stations disposed about the path of movement thereof.

Initially, a portion of photoconductive drum 10 passes through the charging station. At the charging station, two corona generating devices, indicated generally by the reference numerals 14 and 16, charge photoconductive drum 10 to a relatively high, substantially uniform potential.

Next, the charged photoconductive surface is rotated to the exposure station. At the exposure station, a raster output scanner (ROS) 18 illuminates the charged portion of photoconductive drum 10 to selectively discharge photoconductive drum 10 so as to record an electrostatic latent image thereon. The regions of the charged photoconductive drum illuminated by ROS 18 correspond to the image regions. Thus, the image regions are discharged and the non-image regions remain charged. For example, if the image is to contain red, the charged, non-image regions will be developed with a cyan colored liquid developer material. Similarly, if the image is to contain green, the non-image regions will be developed with magenta colored liquid developer material, while an image containing blue will be developed with yellow liquid developer material. ROS 18 includes a laser with a a rotating polygon mirror. Preferably, the laser is a helium neon laser.

After the electrostatic latent image has been recorded on photoconductive drum 10, drum 10 advances the electrostatic latent image to the development station. The development station includes four individual developer units generally indicated by the reference numerals 20, 22, 24 and 26. Each of the developer units is substantially identical to one another. The only distinction between the developer units is the color of the liquid developer material contained therein. Each developer unit includes developer rolls which advance the liquid developer material into contact with photoconductive drum 10. The liquid developer includes a clear carrier and colored toner. In this way, liquid developer material is brought into contact with the latent image formed on drum 10. Developer material is attracted electrostatically to the image areas forming a liquid image on drum 10. Preferably, the developer material includes a clear liquid insulating carrier having pigmented particles, i.e. toner particles, dispersed therien A suitable clear insulating liquid carrier may be made from an aliphatic hydrocarbon, such as an Isopar, which is a trademark of the Exxon Corporation, having a low boiling point. The toner particles include a pigment associated with a polymer. A suitable liquid developer material is described in U.S. Pat. No. 4,582,774, issued to Landa in 1986, the relevant portions thereof being incorporated into the present application. The color of the toner particles contained within each developer unit is adapted to absorb light within a preselected spectral region of the electromagnetic wave spectrum. For example, developer unit 20 includes a liquid developer material containing a clear liquid carrier and green absorbing magenta toner particles. Similarly, developer unit 22 includes a liquid developer material containing a clear liquid carrier and blue absorbing yellow toner particles. Developer unit 24 includes a clear liquid carrier and red absorbing cyan toner particles. Developer unit 26 contains a clear liquid carrier and black toner particles. Each of the developer units is moved into and out of the operative position. In the operative position, the developer roll is closely adjacent the photoconductive belt. In the non-operative position, the developer roll is spaced from the photoconductive drum. During development of each electrostatic latent image only one developer unit is in the operative position, the remaining developer units are in the non-operative position. This insures that each electrostatic latent image is developed with appropriate colored liquid developer material without co-mingling. In FIGS. 1 and 2, developer unit 20 is shown in the operative position with developer units 22, 24 and 26 being in the non-operative position. All of the developer units are mounted on a trolley 28 which translates. Trolley 28 moves one of the developer units to the operative position opposed from photoconductive drum 10. The developer unit translated to the operative position is then elevated to a position adjacent drum 10. Metering roll 30 controls the quantity of developer material deposited on drum 10 and removes the excess therefrom.

After development, the liquid image is moved to the transfer station where the liquid image is transferred to a sheet 32, such as plain paper amongst others. Sheet 32 is advanced to the transfer station. Before sheet 32 advances to the transfer station, it passes through a pre-wetting station. At the pre-wetting station, a wetting roll 34 applies a solvent to a surface of sheet 32. At the transfer station, a transfer drum, indicated generally by the reference numeral 36, receives sheet 32. The sheet is advanced from a stack of sheets 38 disposed on a tray. The sheet is advanced in synchronism with the movement of a gripper rotating with drum 36. In this way, the leading edge of the sheet arrives at a preselected position to be received by the open gripper. The gripper then closes securing the sheet thereto for movement therewith in a recirculating path. The leading edge of the sheet is secured releasably by the gripper. Internal and external corona generators 42 and 44 tack sheet 32 to drum 36. As transfer drum 36 rotates in the direction of arrow 40, the sheet moves into contact with the photoconductive drum, in synchronism with the liquid image developed thereon. Drum 36 is pressed into contact with photoconductive drum 10 at transfer zone 46 and deforms thereat to define a wide contact area. A conductive rubber roll 48, disposed internally of drum 36, is electrically biased to tack the liquid image to photoconductive drum 10. A corona generating device, disposed internally of drum 36 adjacent roll 48, sprays ions onto the backside of the drum so as to charge the sheet to the proper magnitude and polarity for attracting the liquid image from photoconductive drum 10 thereto. The sheet remains secured to the gripper so as to move in a recirculating path for four cycles. In this way, the cyan, yellow, magenta and black liquid images are transferred to the sheet in superimposed registration with one another to form a multi-color image.

After the last transfer operation, the grippers open and release the sheet. Internal and external corona generators detack sheet 32 from drum 36 and discharge transfer drum 36. A conveyor transports the sheet to the fusing station where fuser plate 52 heats the sheet to permanently fuse the transferred image to the sheet. Thereafter, the sheet is advanced by forwarding roll pairs 54 to a catch tray 90 for subsequent removal therefrom by the machine operator.

Figure 3:
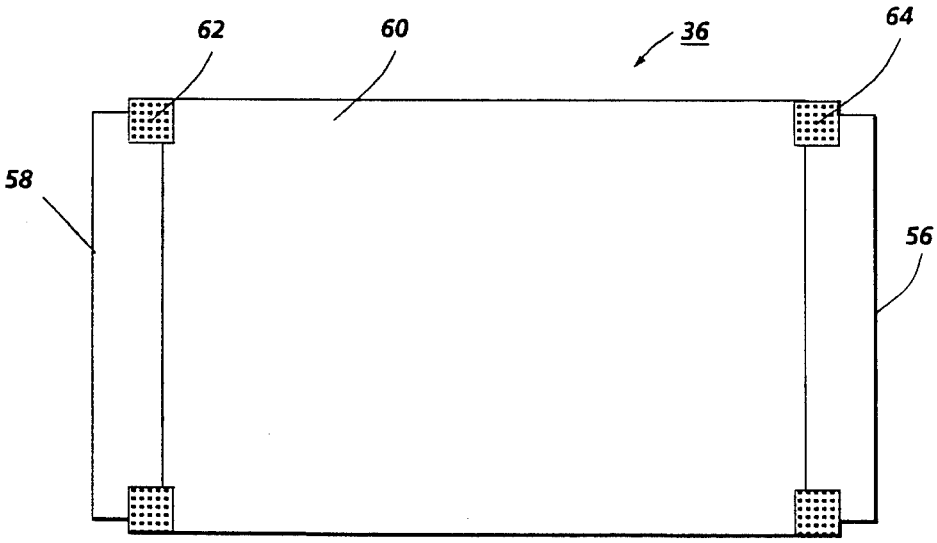
FIG. 3 is a schematic, side elevational view showing the transfer drum of the FIG. 1 printing machine.

Referring now to FIG. 3, transfer drum 36 is shown in greater detail. Transfer drum 36 includes opposed spaced cylindrical hubs 56 and 58. A flexible tubular sheet 60 is supported on opposed end regions by hubs 56 and 58. Hubs 56 and 58 are mounted internally of tubular sheet 60 in opposed marginal end regions thereof. Resilient strips 62 and 64 are interposed between hubs 56 and 58 and cylindrical sheet 60 in the end regions thereof. Strips 62 and 64 are cylindrical and preferably made from a rubber or polyurethane foam material. Flexible sheet 60 is made from a dielectric material, such as Mylar or Kynar, a trademark of the DuPont Corporation.

In recapitulation, the printing machine of the present invention includes a transfer drum which is made from a flexible, tubular dielectric sheet supported by a pair of spaced hubs disposed internally therof. Resilient strips are interposed between the hubs and the sheet to provide a resilient mounting for the sheet. The drum presses against the photoconductive member to form a wide transfer area through which the sheet is advanced. The sheet is secured to the drum and moves in a recirculating path so that successive different color liquid images may be transferred thereto in superimposed registration with one another. An electrically biased conductive roll, positioned internally of the transfer drum, tacks the liquid image to the photoconductive drum. A corona generating device, located internally of the drum adjacent the conductive roll, attracts the liquid image from the photoconductive drum to the sheet.

It is, therefore, evident that there has been provided in accordance with the present invention, a transfer apparatus that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

I claim:

1. An apparatus for transferring a liquid image from an image support surface to a sheet, including:

a deformable cylindrical member comprised of a dielectric material, said cylindrical member being deformed to define a transfer area when pressing the sheet against the image support surface;

means, disposed interiorly of said cylindrical member in the region of the transfer area, for tacking the liquid image to the image support surface; and means, disposed interiorly of said cylindrical member in the region of the transfer area adjacent said tacking means, for transferring the the liquid image from the image support surface to the sheet.

2. An apparatus according claim 1, wherein said cylindrical member includes:

a tubular flexible sheet;

a pair of opposed, spaced support members with one support member supporting one end of said tubular flexible sheet and the other support member supporting the other end of said tubular flexible sheet.

3. An apparatus according claim 2, wherein said tacking means includes an electrically biased conductive roll.

4. An apparatus according to claim 3, wherein said transferring means includes a corona generating device.

5. An apparatus according to claim 4, wherein said pair of support members include:

a pair of substantially rigid hub members spaced from one another with one of said pair of hub members being at least partially disposed in one end of said flexible tubular sheet and the other of said pair of hub members being at least partially disposed in the other end of said flexible tubular sheet; and a pair of resilient members spaced from one another with one of said pair of resilient members being interposed between one of said pair of hub members and said flexible tubular sheet at one end thereof and the other one of said pair of resilient members being interposed between the other one of said pair of hub members and said flexible tubular sheet at the other end thereof.

6. An apparatus according to claim 5, further including means for tacking the sheet to the flexible tubular sheet for movement therewith.

7. An apparatus according to claim 6, further including means for discharging the dielectric material of said cylindrical member.

8. A printing machine of the type in which a liquid image is transferred from a photoconductive drum to a sheet, wherein the improvement includes:

a deformable cylindrical member comprised of a dielectric material, said cylindrical member deforming to define a transfer area when pressing the sheet against the photoconductive drum;

means, disposed interiorly of said cylindrical member in the region of the transfer area, for tacking the liquid image to the photoconductive drum; and means, disposed interiorly of said cylindrical member in the region of the transfer area adjacent said tacking means, for transferring the the liquid image from the photoconductive drum to the sheet.

9. A printing machine according to claim 8, wherein said cylindrical member includes:

a tubular flexible sheet;

a pair of opposed, spaced support members with one support member supporting one end of said tubular flexible sheet and the other support member supporting the other end of said tubular flexible sheet.

10. A printing machine according to claim 9, wherein said tacking means includes an electrically biased conductive roll.

11. A printing machine according to claim 10, wherein said transferring means includes a corona generating device.

12. A printing machine according to claim 11, wherein said pair of support members include:

a pair of substantially rigid hub members spaced from one another with one of said pair of hub members being at least partially disposed in one end of said flexible tubular sheet and the other of said pair of hub members being at least partially disposed in the other end of said flexible tubular sheet; and a pair of resilient members spaced from one another with one of said pair of resilient members being interposed between one of said pair of hub members and said flexible tubbular sheet at one end thereof and the other one of said pair of resilient members being interposed between the other one of said pair of hub members and said flexible tubular sheet at the other end thereof.

13. A printing machine according to claim 12, further including means for tacking the sheet to said flexible tubular sheet for movement therewith.

14. A printing machine according to claim 13, further including means for discharging the dielectric material of said cylindrical member.

* * * * *